US006603934B2

(12) United States Patent
Shimmura

(10) Patent No.: US 6,603,934 B2
(45) Date of Patent: Aug. 5, 2003

(54) METHOD AND APPARATUS FOR FORMING IMAGE

(75) Inventor: Shoko Shimmura, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/024,384

(22) Filed: Dec. 21, 2001

(65) Prior Publication Data

US 2003/0118361 A1 Jun. 26, 2003

(51) Int. Cl.[7] ..... G03G 15/10

(52) U.S. Cl. ..... 399/49; 399/46; 399/57; 399/58; 399/72

(58) Field of Search ..... 399/49, 46, 50, 399/51, 53, 55, 57, 60, 61, 64, 72, 74; 347/188; 358/296, 504, 406

(56) References Cited

U.S. PATENT DOCUMENTS 5,103,260 A * 4/1992 Tompkins et al. ..... 399/72 X
5,493,321 A * 2/1996 Zwadlo ..... 347/188 X
5,582,646 A * 12/1996 Woollam et al. ..... 118/708
5,706,095 A * 1/1998 Rathbun ..... 399/57 X
5,737,666 A * 4/1998 Lior et al. ..... 399/57
6,115,561 A * 9/2000 Fukushima ..... 399/49
6,219,501 B1 * 4/2001 Zhao et al. ..... 399/57
6,229,972 B1 * 5/2001 Rushing ..... 399/74

FOREIGN PATENT DOCUMENTS

JP 4-243283 8/1992
JP 8-327331 12/1996

* cited by examiner

*Primary Examiner*—Sophia S. Chen
(74) *Attorney, Agent, or Firm*—Foley & Lardner

(57) ABSTRACT

The present invention employs a thickness detecting mechanism including a system for emitting polarized light and a reception system for receiving reflected light and generating electric signals. By use of this thickness detecting mechanism, the thickness of a toner layer attached to a latent image is measured. Developing conditions are controlled in relation to the measured thickness.

16 Claims, 7 Drawing Sheets

METHOD AND APPARATUS FOR FORMING IMAGE

BACKGROUND OF THE INVENTION

The present invention relates to an image forming apparatus that forms a toner image by use of a liquid developer in which toner is dispersed in a solvent.

An image forming apparatus is exemplified by a copying machine which utilizes the electrostatic copying process. This type of copying machine forms an electrostatic latent image on a photosensitive body. The electrostatic latent image corresponds to image information on an original, i.e., an object to be copied, and the image information is sent to the photosensitive body as light-and-shade information. The electrostatic latent image is then visualized by the toner, i.e., a developer. As one method for supplying toner to the electrostatic latent image, the use of the liquid developer in which toner is dispersed in a solvent is known.

In comparison with an image forming apparatus using a dry developer, an image forming apparatus using a liquid developer is advantageous in that the toner it uses is made of small-diameter particles. The use of such toner helps improve the image quality (high image quality), and increases the image forming speed. In addition, the liquid developer is advantageous in that it ensures improved gradation characteristics and enables production of images image that are very high in resolution like printed process. Moreover, the toner has a low melting point, and a toner image can be fixed easily.

However, since the developer is in the liquid state and includes toner particles and a carrier liquid, there is still room for improvement with respect to the method in which the developer is supplied and the method in which a residual developer liquid (a carrier liquid functioning as a solvent) remaining on a photosensitive body is removed. In particular, this holds true for an image formation method in which a color image is obtained by superposing toner images of three or four colors on a photosensitive body and then simultaneously transferring them onto a transfer material. In this image formation method, the developer image of the first color must not mix with the developer images of the next colors after development of the first color. To achieve this, the amount of solvent included in the developer image on the photosensitive body has to be reduced, for example, by non-contact wring, contact wring, drying by air supply, etc.

A wet-type image forming apparatus using a liquid developer has problems in that the image density (image quality) of a toner image formed on the photosensitive body and that of an image (toner) transferred onto a transfer material are not stable.

To solve this problem, a patch of predetermined size (a test image) is formed on a photosensitive body. After the patch is subject to development, the amount of toner attached to the patch is measured, and the measurement is fed back when a toner replenishment operation is performed or when a toner consumption condition (developing condition) is determined. This kind of control is well known in the art.

For example, U.S. Pat. No. 4,082,445 discloses a method in which the amount of toner attached to a photosensitive body is measured by checking the amount of light reflected from a non-image portion of the image bearing member (i.e., the photosensitive body) and the amount of light reflected from a toner layer obtained by developing a latent image and comparing the difference between these amounts with a reference value.

It should be noted, however, that the amount of toner attached to the photosensitive body (i.e., the total amount of toner constituting a toner layer) and the absorption index of light do not vary linearly (non-linear). Let us assume that the surface of the photosensitive body is completely covered with toner particles. In this state of (toner) layer, the reflection factor of light hardly varies without reference to the number of toner layers formed.

In contrast, in the state where the surface of the photosensitive body is partly exposed between toner layer portions, the reflection by the surface of the photosensitive body is inevitably sensed as the reflection factor of the light falling on the toner layer. This being so, the amount of toner attached cannot be accurately measured. It should be also noted that the reflection by the surface of the photosensitive body is dependent on changes in the surface roughness of the photosensitive body, changes in the thickness of the photosensitive layer of the photosensitive body, the occurrence of filming of toner, etc.

With respect to color toner, there may be a case where the thickness of a toner layer cannot be measured, depending upon the combination between the spectral reflection characteristics of the toner and the surface of the photosensitive body. In addition, the wavelength of measurement light must be changed in accordance with the color of toner.

As can be seen from the above, the method shown in U.S. Pat. No. 4,082,445 does not necessarily enable accurate measurement of the amount of toner attached to the photosensitive body.

Jpn. Pat. Appln. KOKAI Publication No. 8-327331 discloses a developer amount measuring method for use in a dry-type image forming apparatus. This method employs a lens that provides different image formation positions in accordance with the thickness of a toner layer. An optical position-detecting element detects the variation (difference) in the image formation positions of the lens.

However, toner particles used in wet-type development are very fine; they are in the range of 0.2 to 1.5 $\mu$m. Even if the amount of toner attaching on a transfer medium changes to such an extent as to change the reflecting density of an image transferred onto that medium, the position where light is focused on the toner layer does not significantly change. Therefore, a change in the amount of toner adhering is hard to detect.

Jpn. Pat. Appln. KOKAI Publication No. 8-87144 shows a method for measuring the thickness of a toner layer. According to the publication, the potential of the toner layer obtained by development is measured to detect the thickness of the toner layer. The publication does not describe anything regarding wet-type development, and in view of the drawings and an embodiment, the publication is considered to relate to dry-type development.

However, the toner used for wet-type development does not contain a high proportion of resin. In comparison with the toner used for dry-type development, the potential of a toner layer formed with the toner for wet-type development is likely to be affected by pigments. The toner used for wet-type development does not produce such a toner layer thickness as shown in Jpn. Pat. Appln. KOKAI Publication No. 8-87144. In particular, when magenta toner is used, there is no substantial potential difference between a toner layer and a latent image. Even if the potential at the toner layer is utilized, the amount of toner attaching cannot be detected with high precision.

As discussed above, none of the techniques shown in the known publications enable accurate detection of the thickness of a toner layer formed on a photosensitive body after development as long as the development is wet-type development using fine toner particles whose average particles diameter is in the range of 0.2 to 1.5 μm. (In other words, there is no established detection method.) In particular, in the case of wet-type development of color images, wherein toner images of three or four colors are superposed on a photosensitive body and are simultaneously transferred to a transfer medium, the development of each color is followed by the reduction of the amount of solvent contained in the developer image formed on the photosensitive body, so as to prevent color mixing. For example, the non-contact or contact wring of the solvent, the drying of the solvent by air supply, etc. are repeatedly executed, so that the developer image of each color may not mix with the developer images of the subsequent colors after development of each color. For this reason, the sensing of the thickness of a toner layer is much more difficult.

BRIEF SUMMARY OF THE INVENTION

An object of the present invention is to provide an image forming method and an image forming apparatus that are capable of measuring the amount of developer contained in a wet-type electrophotographic developing agent on a photosensitive body or a transfer medium. The present invention has been made in consideration of the above problems and provides an electrophotographic developing apparatus which develops a latent image on a photosensitive body by use of a toner liquid in which toner is dispersed in a nonpolarity solvent and which thereby forms a toner image on the photosensitive body, the electrophotographic developing apparatus comprising:

a photosensitive body which can hold an electrostatic image;

a charging unit which provides the photosensitive body with a predetermined potential;

an exposure unit which forms an electrostatic image on the photosensitive body;

a developing unit which includes a developing roller opposing the photosensitive body with a predetermined gap maintained, and which supplies a toner liquid to the electrostatic image formed on the photosensitive body such that toner is selectively attached to the electrostatic image, thereby forming a toner image;

a developing bias source which can apply a predetermined bias voltage to the developing unit;

a toner layer thickness-detecting mechanism which detects the thickness of toner constituting the toner image, the toner layer thickness-detecting mechanism including an emission system which emits polarized light toward a toner image formed by the developing unit, and a reception system which receives the polarized light reflected by the toner image and produces an electric signal; and an image formation condition-controlling device which controls at least one of an output from the charting unit, an output from the exposure unit and the bias voltage applied by the developing bias source, on the basis of the thickness of the toner layer detected by the toner layer thickness-detecting mechanism.

The present also provides an electrophotographic developing method which develops a latent image on a photosensitive body by use of a toner liquid in which toner is dispersed in a non-polarity solvent and which thereby forms a toner image on the photosensitive body, the electrophotographic developing method comprising:

providing the photosensitive body with a predetermined potential;

forming a test image by exposure by use of an exposure unit;

forming a toner layer on the photosensitive body by developing the test image;

irradiating the toner layer with polarized light and measuring the thickness of the toner layer on the basis of reflected light reflected by the toner layer by use of a layer thickness-detecting mechanism, the toner layer thickness-detecting mechanism including an emission system which emits polarized light and a reception system which receives the reflected light and produces an electric signal; and comparing the thickness of the toner layer with a reference value and varying at least one of the potential provided for the photosensitive body, an intensity of exposure light output from the exposure unit, a toner density of the toner liquid and a developing bias voltage applied to a developing unit.

The present invention further provides a method which is based on subtractive primaries and forms a color image by using first-color toner, second-color toner and third-color toner, which produce first to third complementary colors to three primary colors and by further using seventh-color toner which emphasizes black, the method comprising:

rotating a photosensitive body at a predetermined rate;

charging the photosensitive body, which is capable of holding an electrostatic image thereon, to a predetermined potential that enables formation of a first-color toner image;

irradiating the photosensitive body with light corresponding to image data used for forming the first-color toner image;

forming the first-color toner image by supplying the first-color toner to an electrostatic image corresponding to the first-color toner image;

charging the photosensitive body, which is capable of holding an electrostatic image thereon, to a predetermined potential that enables formation of both a second-color toner image and a fourth-color toner image, the fourth-color toner image being an image obtained by superposing the first-color toner and the second-color toner;

irradiating the photosensitive body with light corresponding to image data used for forming the second-color toner image and the fourth-color toner image;

forming the second-color toner image and the fourth-color toner image by supplying the second-color toner to electrostatic images corresponding to the second-color toner image and fourth-color toner image;

charging the photosensitive body, which is capable of holding an electrostatic image thereon, to a predetermined potential that enables formation of a third-color toner image, a fifth-color toner image and a sixth-color toner image, the fifth toner image being an image obtained by superposing the second-color toner and the third-color toner, and the sixth-color toner image being an image obtained by superposing the first-color toner and the third-color toner;

irradiating the photosensitive body with light corresponding to image data used for forming the third-color toner image, the fifth-color toner image and the sixth-color toner image;

forming the second-color toner image, the fifth-color toner image and the sixth-color toner image by supplying the second-color toner to electrostatic images corresponding to the second-color toner image, the fifth-color toner image and sixth-color toner image;

charging the photosensitive body, which is capable of holding an electrostatic image thereon, to a predetermined potential that enables formation of a seventh-color toner image, the seventh-color toner image being formed without reference to an order in which the first to sixth-color toner images are formed;

irradiating the photosensitive body with light corresponding to image data used for forming the seventh-color toner image;

forming the seventh-color toner image by supplying the seventh-color toner to an electrostatic image corresponding to the seventh-color toner image;

detecting the thickness of each of the toner layers by use of a toner layer thickness-detecting device in a state where the photosensitive body is rotating, the toner layer thickness-detecting device including an emission system which emits polarized light toward each of the toner images, and a reception system which receives the polarized light reflected by each toner image and produces an electric signal;

comparing the thickness of each of the toner layers with a reference value; and varying at least one of a potential provided for the photosensitive body to obtain a desired image, the amount of light output from an exposure unit to obtain the desired toner image, a toner density of a given toner liquid and a developing bias voltage applied to a developing unit containing the given toner liquid, in accordance with a result of comparison.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will now be described in detail with reference to the accompanying drawings.

Figure 1:
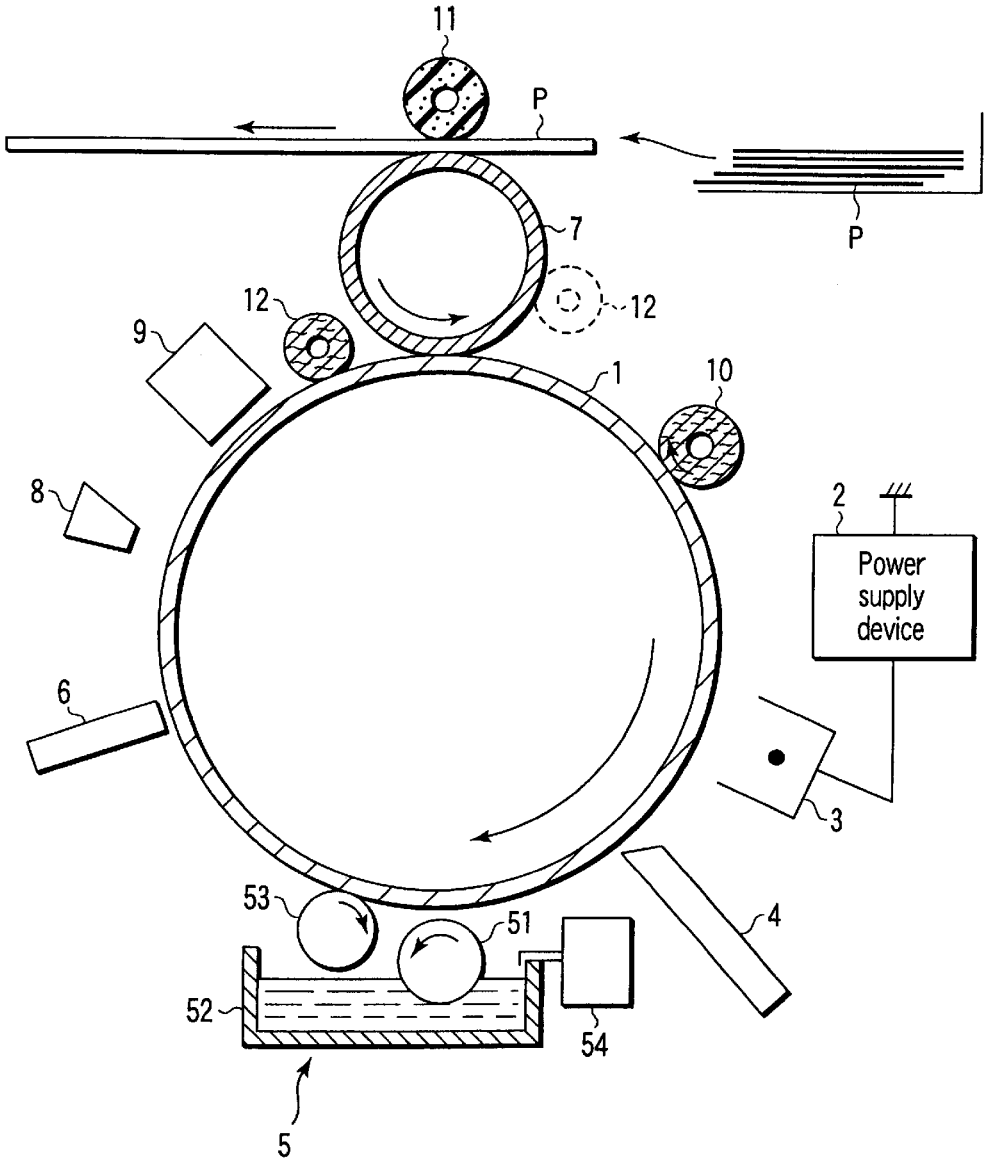
FIG. 1 is a schematic illustration showing a wet-type image forming apparatus to which an embodiment of the present invention is applicable.

FIG. 1 is a schematic illustration showing an example of an electrophotographic apparatus (image forming apparatus) to which an embodiment of the present invention is applicable. The electrophotographic apparatus develops a latent image, using a toner liquid in which toner is dispersed in a solvent.

Referring to FIG. 1, the image forming apparatus (wet-type electrophotographic apparatus) includes a photosensitive body 1. The photosensitive body 1 includes a base member which is made, for example, of a cylindrical aluminum member or a sheet-like aluminum member. An optical semiconductor layer having a predetermined thickness is formed on the base member. To be more specific, the photosensitive body 1 includes an aluminum cylinder (drum) having a diameter of e.g. 150 mm and an organic photosensitive layer (not shown) formed on the surface of the cylinder. A hard coating layer (a surface protection film) which has a thickness of about 1 $\mu$m and formed of a silicone-based material is provided on the outer circumference of the organic photosensitive layer.

A charging unit 3 is provided at a predetermined position on the outer circumference of the photosensitive member 1. The charging unit 3 provides the photosensitive body 1 with a potential which is determined in accordance with the voltage applied by a power supply device 2.

The charging unit 3 may be either a corona discharge type, such as a scorotron, or a contact charging type employing a charging roller or the like. The roller type of charging unit will be described later with reference to FIG. 6. In the present embodiment, the scorotron 3 uniformly charges the photosensitive body 1 to have a potential which is within the range of, e.g., 600V to 800V.

The photosensitive body 1 is rotated by a drum motor (not shown). The rotating speed of the photosensitive body 1 is N (N: the number of rotations per minute), which attains a predetermined process speed, i.e., the moving speed of the outer circumferential surface. For example, the process speed is 220 mm/sec.

After being charged to a predetermined potential, the photosensitive body 1 is irradiated with light emitted from an exposure unit 4 and corresponding to image information to be output. The exposure unit 4 is located close to the charging unit 3 and downstream of it with respect to the rotating direction of the photosensitive body 1. As a result, an electrostatic image (a latent image) corresponding to the image information is formed. The exposure unit 4 is a known type. For example, it may be a laser beam exposure unit (not detailed) which exposes a laser beam in the axial direction of the photosensitive body 1 to form an image. Alternatively, it may be a line LED (not detailed) including a plurality of LED elements linearly arranged at predetermined pitches.

The latent image exposure unit 4 forms on the outer circumference of the photosensitive body 1 is developed (visualized) when it is selectively supplied with a developing liquid (toner) by wet-type developing unit 5. The developing unit is located close to the exposure unit 4 and downstream of the exposure unit 4 with respect to the rotating direction of the photosensitive body 1. The developing unit 5 will be described below with reference to FIG. 2A or FIG. 2B.

The wet-type developing unit 5 uses a liquid developing agent including the following: a carrier liquid (solvent) whose main component is a petroleum-based nonpolar solvent; and toner of predetermined color dispersed in the carrier liquid. The toner contains at least pigments (or dyeing materials) and resin. The charging polarity and extent of the developing agent are controlled by use of a charging control agent (an additive). The toner particles have an average diameter of 0.1 to 3 $\mu$m and are substantially spherical or similar in shape.

As will be described in detail later, a developing region, where the developing unit 5 face the photosensitive body 1, is applied with a developing bias voltage of predetermined magnitude, in addition to the surface potential of the photosensitive body 1.

Application of the developing bias voltage enables efficient electrophoresis of the toner dispersed in the developing liquid.

The toner selectively attached to the latent image on the photosensitive body 1 (the latent image is developed with the toner) remains attached thereto by the electrostatic force acting between the photosensitive body 1 and the toner. Since the photosensitive body 1 is rotated in this state, the toner is carried to a drying region where the toner opposes a blower 6 (an air blowing device for drying). This blower 6 is located close to the developing unit 5 and downstream of the developing unit with respect to the rotating direction of the photosensitive body 1.

In the drying region where the toner opposes the blower 6, most of the solvent is removed from between the toner particles and from the surface of the photosensitive body 1. The blower 6 provides unheated air of room temperature from an opening (not detailed) and blows it against the photosensitive body 1.

After most of the solvent is removed, the toner is carried toward an intermediate transfer member 7 in accordance with the rotation of the photosensitive body 1. The intermediate transfer member 7 is located close to the charging unit 3 and downstream of the charging unit 3 with respect to the rotating direction of the photosensitive body 1.

The intermediate transfer member 7 is a cylindrical member having a diameter of approximately 104 mm. This cylindrical member includes a metallic roller having a diameter of 100 mm, and a urethane rubber layer having a hardness of 20° in the JIS-A scale and a thickness of 2 mm. The urethane rubber layer on the surface of the intermediate transfer member 7 exhibits elasticity. The intermediate transfer member 7 is pressed against the surface of the photosensitive body 1, with a load of 5 Kg/cm$^2$ exerted, at least when a toner image is transferred.

A toner layer thickness measuring device 8 provided at a predetermined position between the blower 6 and the intermediate transfer member 7 on the outer circumferential surface of the photosensitive body 1.

The thickness of a toner layer, which is formed of toner (image) attaching to a latent image on the photosensitive body 1, is measured at a toner layer thickness measurement position by the toner layer thickness measuring device 8 which is used the elliptical polarization method, for example. The toner layer thickness measurement position is a position opposing a toner layer thickness measuring device 8 will be described later with reference to FIG. 3.

An electrostatic force (a remaining voltage) extends between the toner and the photosensitive body 1 is removed, when light or a voltage for electrical discharge is applied from an electrically discharging unit 9, when the toner moving from the toner layer thickness measurement position toward the intermediate transfer member 7. This unit is located at a predetermined position between the intermediate transfer member 7 and the toner layer thickness measurement position.

The electrically discharging unit 9 is capable of emitting light whose wavelength provides an absorption sensitivity as high as that of the optical semiconductor layer of the photosensitive body 1. Alternatively, the discharging unit 9 is capable of emitting light whose wavelength is predetermined in such a way that an undesirable residual potential does not remain when the optical semiconductor layer is charged next. The discharging unit 9 is, for example, a cold cathode lamp that does not adversely affect the sensitivity of the photosensitive body 1. In the case where the discharging unit 9 provides a voltage for electrical discharge, an AC voltage or a voltage in which an AC current is superposed on a DC current is used.

The toner, used for developing the latent image on the photosensitive body 1, is transferred onto the intermediate transfer member 7 at the position where the toner touches the intermediate transfer member 7.

A cleaner 10 is arranged at a position which is downstream of the intermediate transfer member 7 and upstream of the charging unit 3 with respect to the rotating direction of the photosensitive body 1. The cleaner extends along the outer circumferential surface of the photosensitive body 1. The cleaner serves to clear the surface of the photosensitive body 1 of the toner that remains on the surface without being transferred. With this structure, the toner that remains on the photosensitive body 1 after the transfer operation is removed from the surface of the photosensitive body 1 before the charging unit 3 provides the photosensitive body 1 with a predetermined potential next time. The cleaner 10 may be a brush extending in parallel to the axis of the photosensitive body 1 and having bristles arranged at a predetermined density. Alternatively, it may be a cleaner including a sponge member, a felt member or a rubber member that is pressed against the photosensitive body 1 with predetermined pressure.

A backup roller 11 is provided at a position predetermined with reference to the outer circumference of the intermediate transfer member 7, e.g., at a position which is away from the transfer position (where the intermediate transfer member 7 and the photosensitive body 1 are in contact with each other) by a predetermined distance. The backup roller 11 serves to transfer toner from the intermediate transfer member 7 to a sheet of paper P (a transfer material).

The backup roller 11 is an elastic roller. It includes a metallic shaft or roller, and a urethane-based rubber layer having a hardness of 5° in the JIS-A scale. The rubber layer has a thickness that permits the backup roller 11 to have a diameter of 100 mm. When an image is formed, the backup roller 11 is heated in such a manner that its surface temperature is as high as 80° C. The backup roller 11 extends in such a manner that its axis is substantially parallel to the axis of the intermediate transfer member 7. The backup roller 11 is shown as being in contact with the outer circumferential surface of the intermediate transfer member 7 at one point; to be more accurate, it is in line contact with the intermediate transfer member 7 in the axial direction. It is pressed against the intermediate transfer member 7, with a predetermined load applied, e.g., about 8 kg/cm$^2$. Pressed against the outer circumference of the intermediate transfer member 7 with this pressure applied, the backup roller 11 is rotated by the intermediate transfer member 7. The backup roller 11 and the intermediate transfer member 7 rotate in such a manner as to move in the same direction at the position of contact (they rotate in opposite directions on their axes of rotation). Therefore, the toner carried by the intermediate transfer member 7 is transferred onto the sheet of paper P, which is supplied into the region between the backup roller 11 and the intermediate transfer member 7. The pressure at the time of transfer is defined by the pressure acting between the intermediate transfer member 7 and the backup roller 11 and by the thickness of the sheet of paper P.

After the toner is transferred, the sheet P is applied with predetermined pressure and heat by a fixing unit (not shown). As a result, the toner is fixed or firmly attached.

The pressure acting between the backup roller 11 and the intermediate transfer member 7 is sufficiently high in comparison with the pressure used in the case of electrostatic transfer (in which case, a transfer voltage is applied from the back side of a sheet of paper P). Since, therefore, toner is firmly attached to the sheet P, the fixing unit may be omitted, if so desired.

The backup roller 11 may provide heat and pressure at a transfer region where the sheet of paper P is pressed against the intermediate transfer member 7. With this function, the backup roller 11 serves as a fixing unit (not shown) as well.

The image forming apparatus in FIG. 1 was described, referring to an offset transfer system wherein a developed image (toner image) is temporarily transferred to the intermediate transfer member 7 before it is transferred onto the sheet of paper P. As describe later with reference to FIG. 6, however, the toner image (developed image) may be transferred directly to the sheet of paper P, without employing the intermediate transfer member 7.

FIG. 1 illustrates the case where the solvent is first removed from the toner layer (toner image), which is obtained by developing a latent image, and then the toner image is transferred to the intermediate transfer member 7. As will be described with reference to FIGS. 2A and 2B, however, a solvent squeeze by a squeezing roller may be executed only for removing fogging toner, which is present on a non-image portion of the surface of the photosensitive body 1. That is, a transfer electric field is applied to the intermediate transfer member 7 in the state where toner is present between the photosensitive body 1 and the intermediate transfer member 7 or in the toner image. As in the case where a latent image is developed, the toner particles of the toner image can be attracted to the intermediate transfer member 7 by electrophoresis.

The developing units will be described with reference to FIG. 2A.

A developing unit 5 include: a developing roller 51 which supplies a liquid like developing agent (toner) to the photosensitive body 1; a housing 52 which contains a predetermined amount of developing liquid (toner) and holds the developing roller 51 in such a manner as to supply the developing liquid toward the photosensitive body 1; a squeeze roller 53 which squeezes a solvent out of the developing liquid (toner) of a latent image formed on the photosensitive body 1; and a condensed replenishment toner liquid-supplying mechanism 54 which adds toner to the developing liquid (the toner is consumed when the latent image formed on the photosensitive body 1 is developed); etc.

The developing roller 51 is, for example, a stainless steel roller having a diameter of 17 mm. It opposes the outer circumference of the photosensitive body 1 shown in FIG. 1, with a gap maintained. The gap is within the range of 50 to 200 $\mu$m; it is 150 $\mu$m, for example.

The developing roller 51 is rotated by a development motor 131 in such a manner that the outer circumferential surface of the roller 51 moves in the same direction as that of the photosensitive body 1 at the position where the developing roller 51 opposes the surface of the photosensitive body 1 (the developing roller 51 and the photosensitive body 1 are rotated on their axes in opposite directions). The developing roller 51 is rotated relative to the photosensitive body 1 at a peripheral speed ratio of 1 to 3. That is, the moving speeds of the outer circumferential surfaces of the developing roller 51 and the photosensitive body 1 are 1:3. In accordance with the rotation of the developing roller 51, the developing liquid contained in the housing 52 is supplied to the developing region, where the developing roller 51 opposes the photosensitive body 1. As a result, the gap between the surface of the photosensitive body 1 and the developing roller 51 is filled with the developing liquid (i.e., the toner and solvent).

In the developing region, electric fields of predetermined directions and intensities are generated. A direction and a magnitude of the electric fields are determined by the potential of the latent image (image portion) formed on the photosensitive body 1, the potential of the portion where the latent image is not formed (non-image portion), and the developing bias voltage applied to the developing roller 51.

In the developing process, the toner is set in the electrophoretic state in the solvent in accordance with the electric fields, which are of different directions and magnitudes determined by the potentials of the latent image (image portion) and the non-image portion and the developing bias voltage applied to the developing roller 51. In the region of the non-image portion, the toner moves toward the developing roller 51, while in the region of the image portion (latent image) it moves toward the latent image.

Figure 2A:
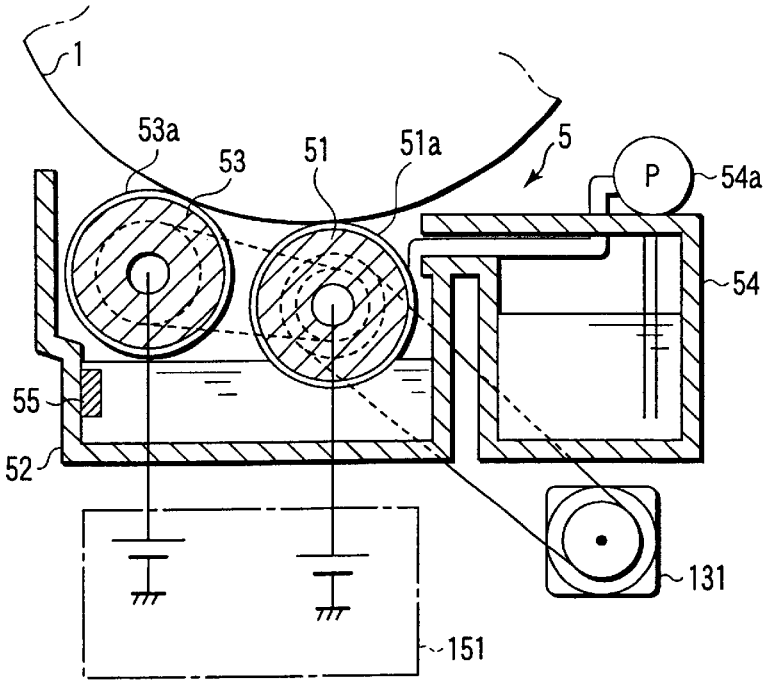
FIG. 2A is a schematic illustration showing a liquid developing unit which is according to the first embodiment of the present invention and which is applicable to the image forming apparatus depicted in FIG. 1.

In the developing unit 5 shown in FIG. 2A, the surface of the developing roller 51 is applied with a developing bias voltage by a developing bias power supply device 151. The developing bias voltage is within the range of 100 to 600V; it is 500V, for example. The surface potential which the power supply device 151 (to be described later with reference to FIG. 5) applies to the photosensitive body 1 is in the range of 600 to 800V; it is 800V, for example.

The toner (each toner particle) has a charge of predetermined magnitude and polarity. In contrast, the solvent (i.e., main ingredients of the developing agent, other than the toner) has a resistance as high as $10^{13}$ Ωcm.

The latent image formed on the photosensitive body 1 is developed when the toner, which is in the electrophoretic state in the solvent between the surface of the photosensitive body 1 and the developing roller 51, attaches thereto. The direction in which the toner moves by the electrophoresis (i.e., whether the toner attaches to the photosensitive body 1 or it is attracted toward the developing roller 51) is dependent on the directions and intensities of the electric flux lines of the electric fields and on the charging polarity and magnitude of the toner. The electric fields are generated by the potential difference between the potential of the latent image (i.e., the surface potential which the photosensitive body 1 exhibits when the image information corresponding to the latent image is formed thereon after it is charged to a predetermined potential) and the developing bias voltage applied to the developing roller 51.

By way of example, let us consider the case where the potential of the latent image is 100V (the image density is low when the difference between that potential and the surface potential of the photosensitive body 1 is small). If the developing bias voltage is 500V, the potential difference between the latent image (image portion) and the developing bias voltage is −400V, and the potential difference between the non-image portion and the developing bias voltage is 300V (the surface potential of the photosensitive body 1 is assumed to be 800V).

If the charging polarity of the toner is positive under these conditions, the toner which is in the electrophoretic state in the neighborhood of the image portion (the latent image) flows (or moves) toward the latent image. On the other hand, the toner which is in the electrophoretic state in the neighborhood of the non-image portion moves (or flows) toward the surface of the developing roller 51.

The moving direction of the toner (i.e., whether the toner moves toward the developing roller 51 [non-image portion] or toward the photosensitive body 1 [latent image]) and the moving distance (extent) of the toner are determined (set) based on at least one of the following:

a) the amount of charge of the individual toner particles;

b) the size of the toner particles;

c) the potential difference between the surface of the photosensitive body 1 and the developing roller 51, and the distance (gap) therebetween; and d) the amount of excess ions present in the solvent.

To the latent image formed on the photosensitive body 1 in the above manner, toner attaches selectively. At the time, a large amount of solvent exists around the toner attaching to the latent image and in the toner layer.

It may happen that the distance between the developing roller 51 and the photosensitive body 1 will be shorter than the distance intended at the time of design. This phenomenon is attributable to a manufacturing error of the developing roller 51 and/or the photosensitive body 1, or to an assembling error which may occur when the developing roller 51 is assembled with reference to the developing unit 5. The phenomenon is also attributable to impurities included in the developing liquid. In this case, the developing bias voltage applied between the developing roller 51 and the photosensitive body 1 may result in an undesirable electric discharge. To prevent this discharge, the surface of the developing roller 51 may be coated with a thin insulating film 51*a*, such as a Kanigen plating, a tufram treatment (trade name) or a fluorine coating.

The squeeze roller 53 is, for example, a roller made of stainless steel and having a diameter of 17 mm. The squeeze roller 53 is disposed inside the housing 52 in such a manner that it is located downstream of the developing roller 51 with respect to the rotating direction of the photosensitive body 1. The squeeze roller 53 defines a gap of e.g. 50 $\mu$m with reference to the outer circumferential surface of the photosensitive body 1.

The squeeze roller 53 receives a driving force transmitted through a set of gears (not shown). The driving force is a force which the developing motor 131 generates for the developing roller 51. Upon reception of the driving force, the squeeze roller 53 is rotated in such a manner that the outer circumferential surface moves in the opposite direction to that of the photosensitive body 1 at the position where the developing roller 53 opposes the surface of the photosensitive body 1. The rotating speed of the squeeze roller 53 is 2 to 4 times (preferably 2.5 times) as high as that of the photosensitive body 1. (The photosensitive body 1 and the squeeze roller 53 are rotated on their axes in the same direction.)

The squeeze roller 53 is applied with a bias voltage (squeeze bias voltage) which is in the range of 100 to 600V; the bias voltage is 150V, for example. In a squeeze region, where the squeeze roller 53 opposes the photosensitive body 1, a predetermined squeeze bias voltage is applied between the photosensitive body 1 and the squeeze roller 53. The squeeze bias voltage is determined in such a manner that the toner is not undesirably attracted from the latent image on the photosensitive body 1 at the time of a squeeze operation, i.e., when the solvent is removed from the developing liquid present on the photosensitive body 1. (The squeeze bias voltage is lower than the developing bias voltage.)

It may happen that the distance between the squeeze roller 53 and the photosensitive body 1 will be shorter than the distance intended at the time of design. This phenomenon is attributable to a manufacturing error of the squeeze roller 53 or an assembling error which may occur when the squeeze roller 53 is assembled in the developing unit 5. The phenomenon is also attributable to impurities included in the developing liquid. In this case, the bias voltage applied between the squeeze roller 53 and the photosensitive body 1 may result in an undesirable electric discharge. To prevent this discharge, the surface of the squeeze roller 51 may be coated with a thin insulating film 53*a*, such as a Kanigen plating, the tufram treatment (trade name) or a fluorine compound coating.

Figure 8A:
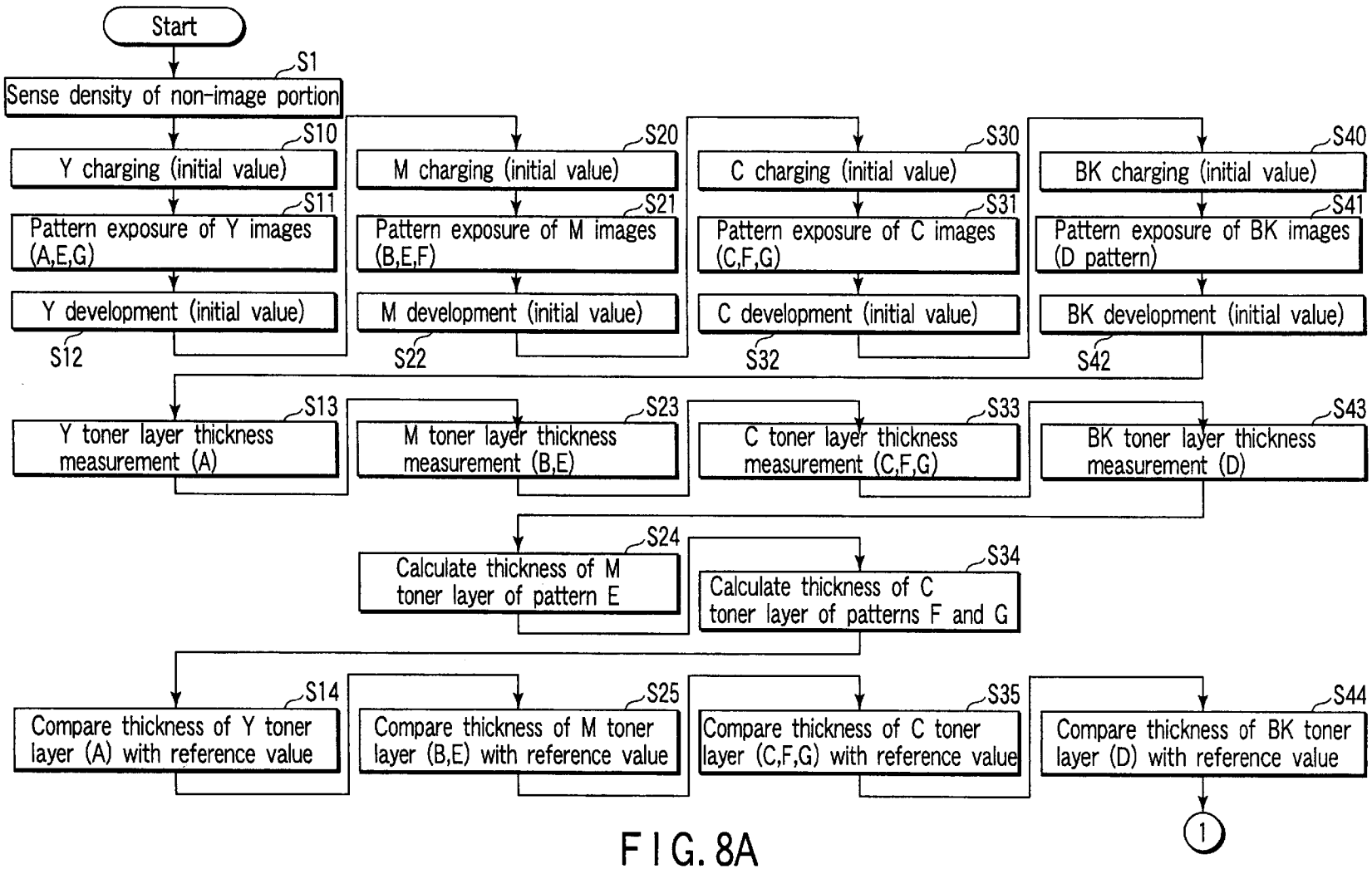
FIGS. 8A and 8B are flowcharts showing an example of a process for setting image formation conditions, the image formation conditions enabling the color image forming apparatus depicted in FIG. 6 to form a color image in which the thickness of each toner layer is optimized and which has desired density and color reproducibility.
Figure 8B:
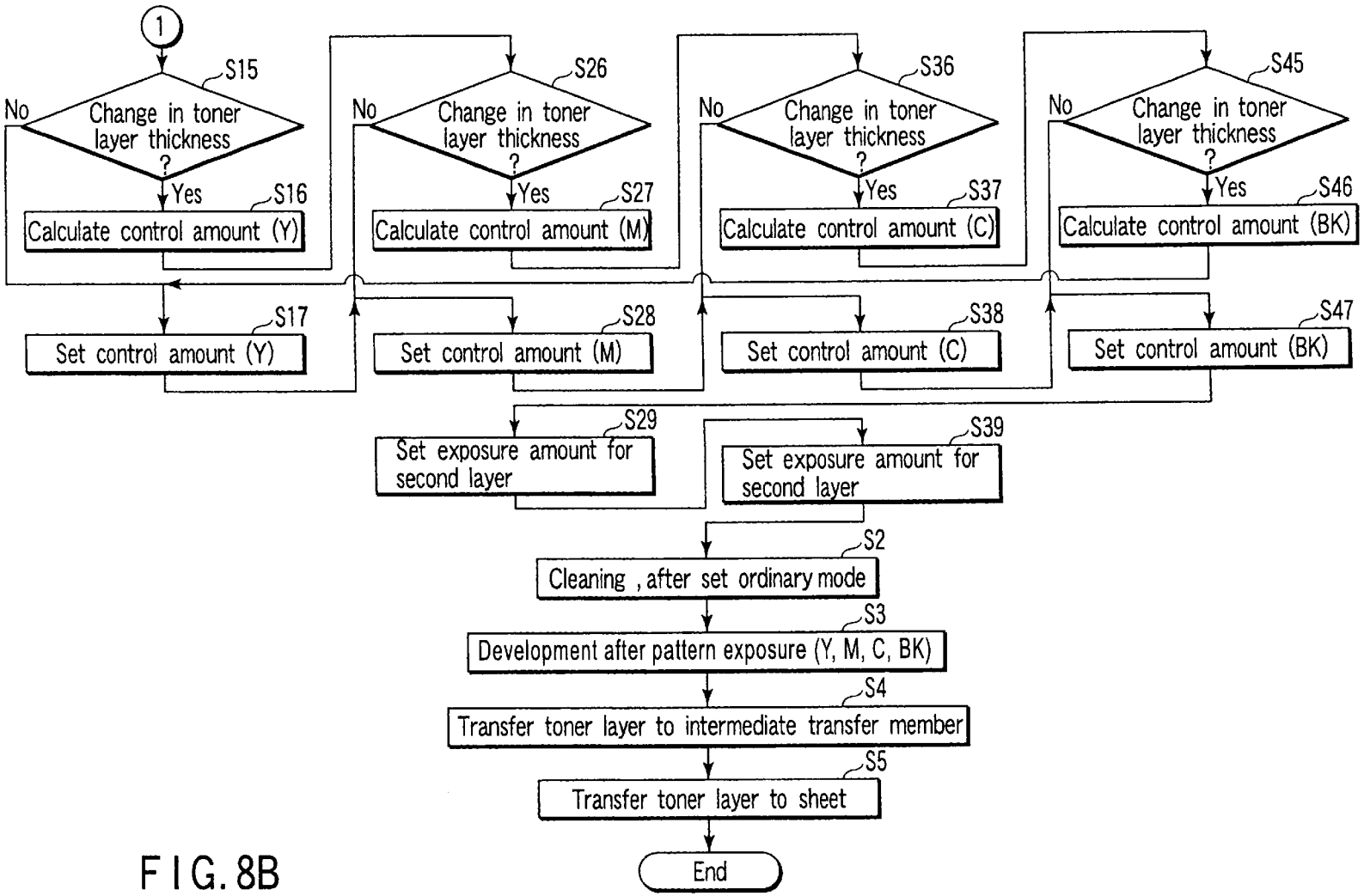

A concentration sensor 55 is located at a predetermined position inside the housing 52. The concentration sensor 55 is either an optical type or an ultrasonic type. In the case of the optical type, the concentration sensor 55 includes a light emitting source which emits light having a predetermined wavelength and optical intensity, and a light receiving element which can output an electric signal corresponding to the optical intensity of incident light. In this case, the concentration sensor 55 outputs a signal representing the amount of light emitted from the emitting source and received by the light receiving element. In the case of the ultrasonic type, the concentration sensor 55 includes a sound source which outputs an ultrasonic wave of a predetermined frequency. In response to an incident ultrasonic wave, the concentration sensor 55 outputs an electric signal corresponding to the magnitude of the ultrasonic wave. When the execution of toner replenishment, which is one of the image forming conditions described later with reference to FIGS. 8A and 8B, is determined (i.e., when toner replenishment is to be executed by means of the condensed replenishment toner liquid-supplying mechanism 54), a toner liquid of the corresponding color is additionally supplied into the housing 52 on the basis of the toner replenishment conditions described later in detail.

Figure 2B:
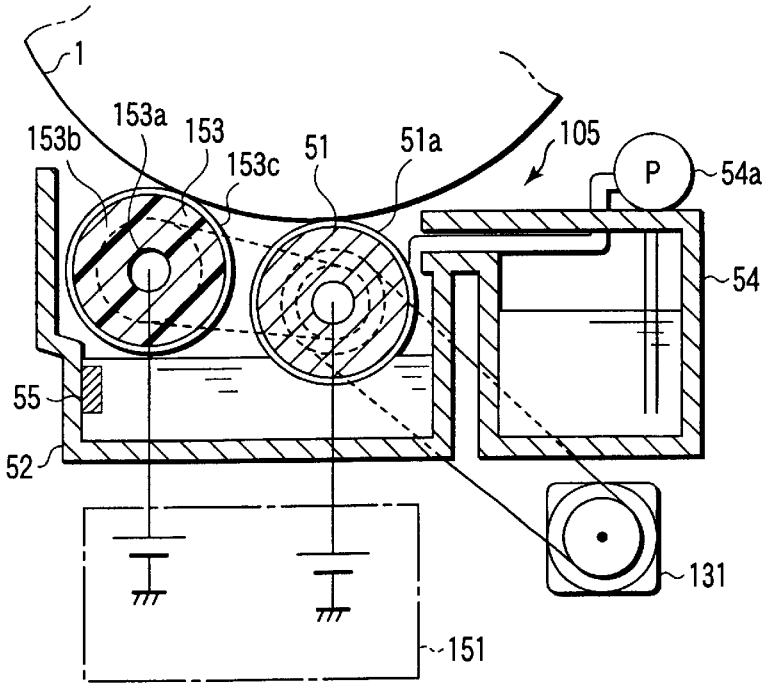
FIG. 2B is a schematic illustration showing a liquid developing unit which is according to the second embodiment of the present invention and which is applicable to the image forming apparatus depicted in FIG. 1.

FIG. 2B is a schematic illustration showing a developing unit according to an embodiment different from that shown in FIG. 2A. In FIG. 2B, the same reference numerals as used in FIG. 2A represent similar or corresponding members, and a description of such members will be omitted. The developing unit shown in FIG. 2B is a modification of the developing unit shown in FIG. 2A, and as described above, descriptions of similar or corresponding members will be omitted. The developing unit 5 of FIG. 2A will be labeled as developing unit 105 in FIG. 2B to differentiate the two units.

In the developing unit shown in FIG. 2B, a squeeze roller 153 is an elastic roller, for example. This roller includes a stainless steel shaft 153*a*, and a urethane-based conductive rubber layer 153*b* formed on the shaft 153*a* and having a predetermined thickness. A silicone-based tube 153*c*, functioning as a solvent-resistant protective layer, is provided on the urethane-based conductive rubber 153*b* as an outermost layer. The specific resistance of the conductive rubber 153*b* is on the order of $10^8$ Ωcm. The outer diameter of the roller 153, including the silicone-based tube, is approximately 20 mm.

The squeeze roller 153 is in contact with the photosensitive body 1 and urged toward the center of the photosensitive body 1 in such a manner as to define a nip of 1 mm. The nip is a distance for which the conductive rubber layer 153*b* and the tube 153*c* of the squeeze roller 153 are deformed when they are pressed against the photosensitive body 1, which is harder than layer 153*b* and tube 153*c*. The nip is measured on the outer circumference of the squeeze roller 153.

The squeeze roller 153 is rotated in such a manner as to move in the same direction as the photosensitive body 1 at the position of contact. There is no substantial peripheral speed difference between the two (the peripheral speed difference may be zero, or slight slipping may be permitted) (the rotation of the squeeze roller is the same as the moving speed of the surface of the photosensitive drum 1). The developing unit shown in FIG. 2B differs from that described above in squeeze condition. Therefore, the voltage applied to the squeeze roller 153 (particularly, the outermost tube 153*c*) is 600V, for example.

The developing liquid contains toner, a charging promoting agent and a petroleum-based nonpolar solvent. The toner includes pigments and resin and in the form of particles whose diameters are within the range of 0.5 to 3 μm, preferably 0.5 to 2 μm. The toner and the nonpolar solvent are dispersed in the solvent. In the present embodiment, the toner is charged to be "positive" with the aid of the charging promoting agent. As the charging promoting agent, known kinds of metallic soap, which is a combination of acids and salts, may be used. The acids include naphthenic acid, octanoic acid, heptanoic acid, stearic acid, etc., and the salts include zirconic salt, manganese salt, nickel salt, ferrous salt, cobaltic salt, zincic salt, etc. The developing (toner) liquid contains the above toner and the charging promoting agent in such a manner that the solid components in the solvent account for 0.1 to 5% by weight.

The developing liquid may contain a dispersion promoting agent which helps promote the dispersion of pigments in the resin. The toner may be charged to be either positive or negative. Normally, the toner is charged to one polarity that is determined in accordance with the charging characteristics of the optical semiconductor of the photosensitive body 1 and the exposure system in use.

An example of a method for measuring the thickness of a toner layer formed on the photosensitive body will now be described with reference to FIGS. 3 and 4.

Figure 3:
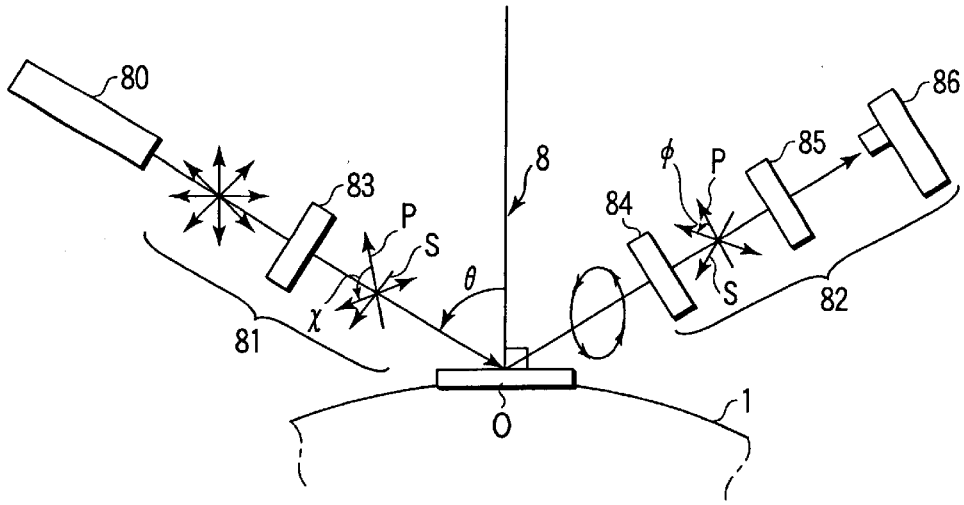
FIG. 3 is a schematic illustration showing an example of a toner layer thickness-measuring device that is incorporated in the image forming apparatus depicted in FIG. 1.

As shown in FIG. 3, the toner layer thickness measuring device 8 is a known type of ellipsometer and includes the following: a light source 80 which emits light of a predetermined wavelength toward a measurement object (toner layer) O; a light guide system 81 which guides the light from the light source 80 to the toner layer O; and a detection system 82 which receives light reflected by the toner layer O and outputs an electric signal corresponding to the optical intensity of the received light. The light source 80 is a semiconductor laser element which emits a laser beam whose wavelength is 632.8 nm, for example.

The light guide system 81 includes a polarizer 83 which allows transmission of only a linearly-polarized light component included in the laser beam emitted from the laser element 80 and having azimuth κ. That is, the light guide system 81 irradiates a linearly-polarized light component whose angle of incidence with respect to a normal line of the toner layer O is θ and which has azimuth κ toward the toner layer O.

The detection system 82 includes a quarter wave plate 84, an analyzer 85 and a light-receiving element 86. The quarter wave plate 84 provides a phase difference of $-\pi/4$ (or $+\pi/4$) for light which is reflected by the toner layer O and which is elliptically polarized thereby. The analyzer 85 detects the azimuth ϕ of the linearly-polarized component of the light which has been transmitted through the quarter wave plate 84. The light-receiving element 86 receives light which has been transmitted through the analyzer 85 and has azimuth ϕ, and outputs an electric signal corresponding to the optical intensity of the light.

An example of a method for measuring the thickness of a toner layer by use of the ellipsometer will now be described with reference to FIG. 4.

Figure 4:
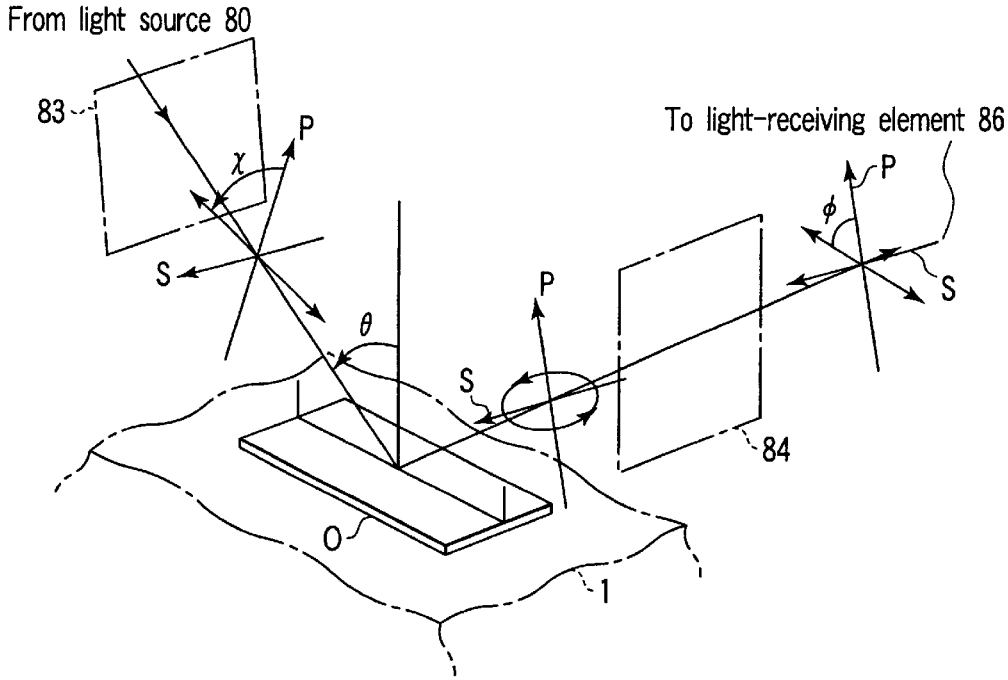
FIG. 4 is a schematic illustration showing an example of a method in which the toner layer thickness-measuring device depicted in FIG. 3 measures the thickness of a toner layer.

Referring to FIG. 4, linearly-polarized light having azimuth κ is reflected by the toner layer O and turned into elliptically polarized light. The phase difference Δ and amplitude ratio ϕ between the polarized components (P and S components) of this elliptically polarized light are detected.

A more specific description will follow. First of all, phase angle Δ, is an angle between the P and S polarized components of the polarized light reflected by the toner layer O, and amplitude ratio ϕ are detected by use of an operation device 121 (which will be described later with reference to FIG. 5).

The amplitude ratio ϕ is obtained by:

$$\tan \phi = |R_P|/|R_S|$$

where $R_P$ is the intensity of the P polarized component, and $R_S$ is the intensity of the S polarized component.

Second, an equation containing an imaginary number term (i), namely $\tan \phi e^{i\Delta} = R_P/R_S$, is derived from the following:

the optical characteristics of the toner of the toner layer O;

the optical characteristics of the surface of the photosensitive body 1 that bears the toner layer; and the optical intensity of light reflected by the surface of the toner layer, and the optical intensity of light reflected by the surface of the photosensitive body 1.

Thereafter, the thickness of the toner layer O is calculated from ϕ and Δ, using a predetermined formula. The formula used in practice is modified or determined in accordance with the detection system (mechanism) used by each ellipsometer.

The time needed for the ellipsometer 8 to detect the thickness of the toner layer O is approximately 1 to 100 msec though this time is dependent on the characteristics of the light guide system 81 (incl. the light source 80), the detection system 82, and a control system (an operation device) to be described with reference to FIG. 5. Assuming that the moving speed (process speed) of the outer circumferential surface of the photosensitive body 1 is 220 mm/sec, a patch required for the measurement of a toner layer should be not smaller than the range of 0.2 to 22 mm in size (length) in the circumferential direction of the photosensitive body 1 (length of toner image [mm]=process speed [mm/sec]×time required for measurement [sec]). By determining the patch size in this manner, the thickness of the toner layer can be detected when the photosensitive body 1 is rotating. It is known that the characteristics of the optical semiconductor layer (not shown) tend to vary in the circumferential direction of the photosensitive body 1. In consideration of this, it is preferable that a test image (patch) be short (small) within the range that enables measurement of the thickness of the toner layer. (The length of the toner image may also be dependent on the measurement capability of the ellipsometer 8.) In the image forming apparatus shown in FIG. 1, the toner layer thickness measuring device 8 measures the thickness of a toner layer based on the toner layer thickness measuring routine described above. It should be noted that the toner layer thickness may be measured in parallel to the routines for the ordinary image formation process, using an area that is outside the image region corresponding to a maximal-size image (latent image) formed on the photosensitive body 1.

A toner image obtained by developing a test image (patch image) formed on the photosensitive body 1 in the toner layer thickness measuring routine, must be removed from the photosensitive body 1 before the intermediate transfer process (which transfers images from the photosensitive body 1 to the cleaner 10) is carried out.

For this reason, it is preferable that a second cleaner 12 be provided in addition to the cleaner 10 described above such that the second cleaner 12 is close to the outer circumference of the photosensitive body 1 and located between the toner layer thickness measuring device 8 and the intermediate transfer member 7. The second cleaner 12 may be of the same type as the cleaner 10. The second cleaner 12 may be omitted if a structure for releasing the contact between the intermediate transfer member 7 and the photosensitive body 1 (i.e., a mechanism for releasing the pressure contact) is added. When this structure is employed, the intermediate transfer member 7 is separated from the photosensitive body 1 when the toner layer thickness measuring routine is being carried out.

To measure the thickness of a toner layer during the image formation process, the effective length of the photosensitive body 1 must be so determined as to enable measurement of the toner layer thickness. In other words, the axial length of the photosensitive body 1 must be determined in such a manner that the size required for the formation of a patch image is provided in addition to the size required for the formation of an ordinary image. Where the axial length of the photosensitive body 1 is determined in this manner, the thickness of the toner layer can be monitored each time an image is formed.

There may be a case where the toner layer on the photosensitive body 1 is completely dry (i.e., the toner layer on the photosensitive body 1 does not contain solvent at all) when a laser beam from the light guide system 81 of the ellipsometer 8 has reached the toner layer. In this case, it is likely that the measurement of the index of refraction will be significantly affected due to the surface characteristic of the toner particles, the shape thereof, etc. If this happens, the accuracy with which to measure the toner layer thickness may be greatly affected.

In the image forming apparatus employing the intermediate transfer member, therefore, the squeeze by the squeeze roller may be decreased to allow the solvent to attach to the intermediate transfer member 7. In this case, the cleaner 12 may be provided just in front of the final transfer position, where the intermediate transfer member 7 and the backup roller 11 are in contract with each other.

Figure 5:
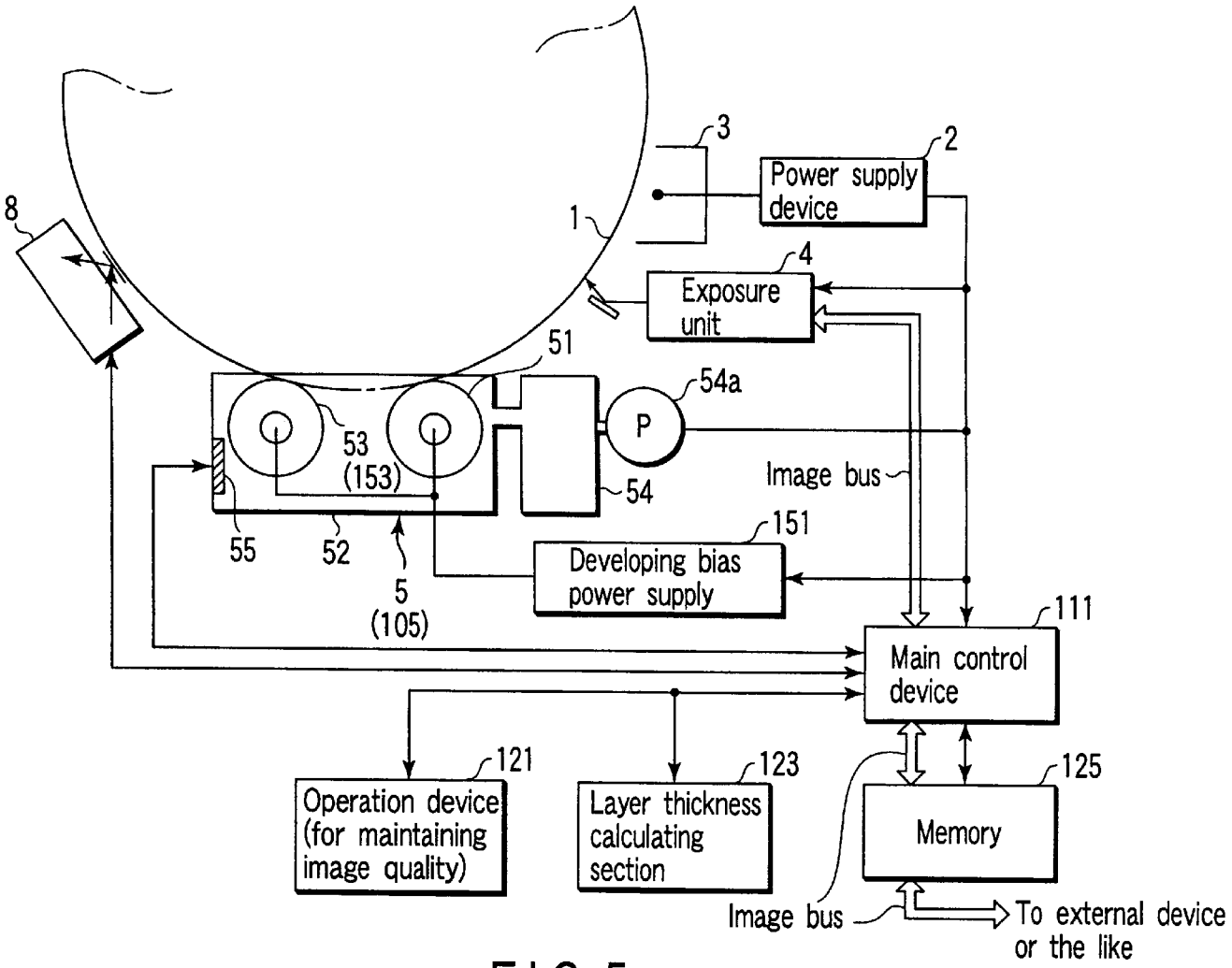
FIG. 5 is a schematic illustration showing how an image of a predetermined density is formed on the basis of the toner layer thickness measured in the toner layer thickness measurement depicted in FIGS. 3 and 4.

FIG. 5 is a schematic illustration showing how the ellipsometer shown in FIGS. 3 and 4 measures the thickness of a toner layer formed on the photosensitive body and how the formation of a desired image is enabled. In accordance with the above description, the developing unit mounted in the image forming apparatus shown in FIG. 5 can be either the developing unit 5 of FIG. 2A or the developing unit 105 of FIG. 2B.

In the toner layer thickness measuring routine mentioned above, or the toner layer thickness measuring step executed simultaneous with the image formation on the photosensitive body, the light-receiving element 86 of the ellipsometer 8 produces an output corresponding to the thickness of a toner layer (an image) whenever the toner layer is formed on the surface of the photosensitive body 1.

The output from the light-receiving element 86 is subjected to an operation the operation device 121 performs according to a predetermined rule. By this operation, the phase difference $\Delta$ and amplitude ratio $\phi$ between the polarized components (P and S components) of elliptically polarized light are output as signals.

The signals output from the operation device 121 and representing the phase difference $\Delta$ and amplitude ratio $\phi$ are supplied to a layer thickness calculating section 123. After the layer thickness calculation by the layer thickness calculating section 123, the thickness of the toner layer is output as a signal.

The thickness of the toner layer output from the layer thickness calculating section 123 is compared with reference values that are stored in a memory 125 beforehand in, e.g., an LUT format (a Look-Up Table format). Each reference value is associated with a given toner layer thickness. Data such as the surface potential of the photosensitive body 1, a developing bias voltage applied to the developing roller 51, the amount of toner consumed (i.e., the amount of toner to be added), etc. are fed back to the corresponding elements by way of a main control device 111.

Under the control of the main control device 111 at least one of an added toner control and a changed developing contrast potential control is executed. In the added toner control, a condensed toner liquid is added to the developing unit 5 (i.e., a pump 54*a* supplies the condensed toner liquid into the housing 52). In the developing contrast potential control, an output from the power supply device 2 (based on which an output from the charging unit 3 is controlled) and the developing bias voltage which the developing bias power supply device 151 applies to the developing roller 51 (i.e., a developing contrast potential) are changed. Accordingly, the thickness of the toner layer is changed within predetermined ranges.

The quality of an output image can be controlled by changing the image formation conditions. For example, if the thickness of a toner layer formed on the photosensitive body 1 is greater than a reference thickness value, the developing potential contrast is lowered. In other words, the amount of toner attached to the latent image is reduced. In addition to this generally-known technique, the developing bias voltage is lowered, or the optical intensity of the exposure light emitted from the exposure unit is reduced. Since these control methods are well known in the art, a detailed description of them will be omitted.

On the other hand, if the thickness of a toner layer formed on the photosensitive body 1 is smaller than the reference thickness value, the developing contrast is increased, or the toner density in the developing liquid is enhanced (the condensed toner liquid is added). In addition to this advantageous technique, the developing bias voltage may be increased, or the optical intensity of the exposure light emitted from the exposure unit may be increased. Since these control methods are well known in the art, a detailed description of them will be omitted.

In the manner described above, whenever a toner image on the photosensitive body 1 is developed, the concentration of the resultant toner image (i.e., the thickness of the toner layer) is kept at a predetermined level.

Since the thickness of a toner layer formed on the photosensitive body 1 as an image is detected by means of an ellipsometer, a toner layer thickness variation of 1 $\mu$m or less can be detected with an accuracy of 10 nm, for example.

In other words, utilizing polarized light for the measurement of a toner layer thickness is advantageous in that the measurement is not affected by the color of toner used, and the color and surface characteristics of the photosensitive body. In addition, the use of this method is considered to ensure a constant solvent concentration (remaining) rate (incl., a reference value) as long as the squeeze or drying conditions are not changed. Hence, the thickness of the toner layer can be measured in a similar manner to that of the case where solvent is not contained. This being so, the blower 6 may be arranged at a position which is downstream of the toner layer thickness measuring device 8 with respect to the rotation direction of the photosensitive body 1. In this case, the thickness of a toner layer is measured in the state where solvent remains in the toner layer.

Figure 6:
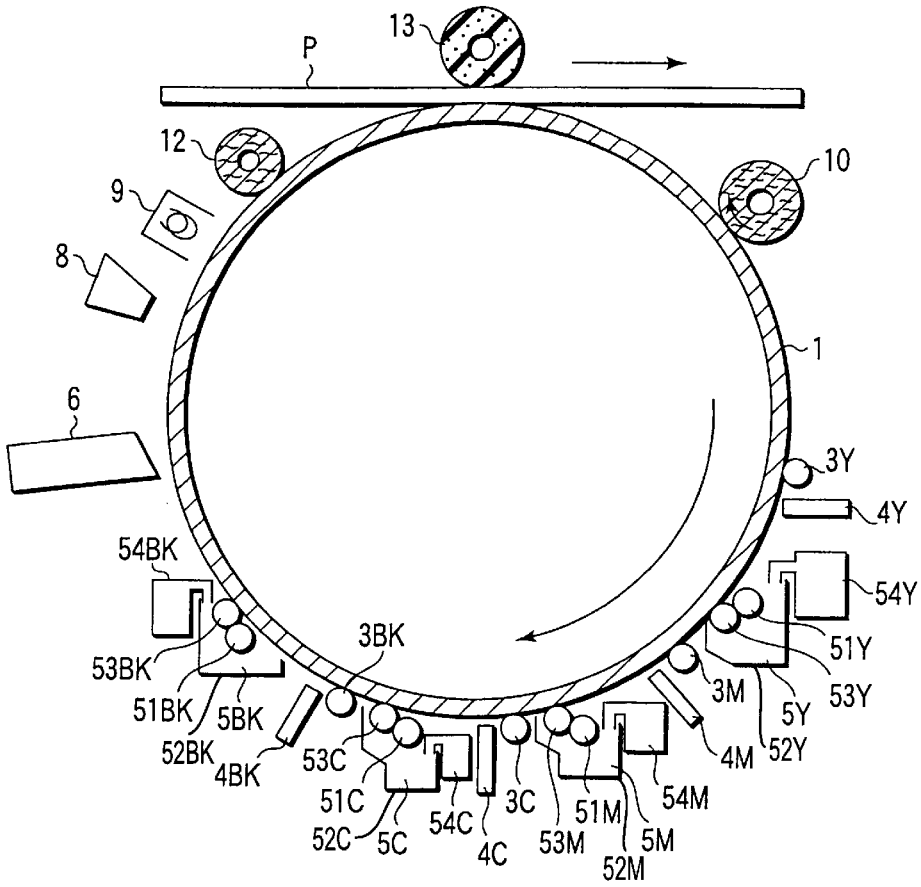
FIG. 6 is a schematic illustration showing an image forming apparatus according to another embodiment of the present invention.

FIG. 6 is a schematic illustration showing an example of a color image forming apparatus. This apparatus employs four wet-type developing units, each of which has such a configuration as described above with reference to FIG. 2A (or 2B), and these developing units are arranged around the photosensitive body 1. In FIG. 6, the same reference numerals as used in FIGS. 1, 2A, 2B and 3–5 denote similar or corresponding structural components, and a description of such components will be omitted. For the purpose of identification, the four developing units will be referred to, with "Y", "M", "C" and "BK" attached, and a detailed description of each developing unit will be omitted.

As shown in FIG. 6, first to third developing units 5Y, 5M and 5C corresponding to the subtractive primaries and a fourth developing unit 5BK used for emphasis the black are arranged around the photosensitive body 1. The first to third developing units 5Y, 5M and 5C contain developing liquids that include pigments exhibiting "Y" (yellow), "M" (magenta) and "C" (cyan), respectively, which are three color components used for forming color images. The fourth developing unit 5BK contain a BK developing liquid used for forming black images. The first to fourth developing units 5Y, 5M, 5C and 5BK are arranged in the rotating direction of the photosensitive body 1 in the order mentioned above shown in FIG. 6. The fourth developing unit 5BK containing a BK developing liquid used for producing a black image may be arranged at an arbitrary position without reference to the order in which the first to third developing units 5Y, 5M and 5C are arranged. Likewise, the first to third developing units 5Y, 5M and 5C, which are used for forming yellow, magenta and cyan colors, may be arranged in an arbitrary order.

First to fourth charging units 3Y, 3M, 3C and 3BK are arranged at positions which are upstream of each of the developing units 5Y, 5M, 5C and 5BK with respect to the rotating direction. By these charging units, the photosensitive body 1 is provided with a predetermined potential.

First to fourth exposure units 4Y, 4M, 4C and 4BK are arranged between the charging units and developing units of the respective colors. In the case of a scanning type exposure apparatus which exposes a laser beam in the axial direction of the photosensitive body 1, the exposure units 4Y, 4M, 4C and 4BK are arranged between the charging units 3Y, 3M, 3C and 3BK and the developing units 5Y, 5M, 5C and 5BK, and final output laser beams from the exposure units 4Y, 4M, 4C and 4BK trace predetermined regions. In the case of an apparatus capable of executing an exposure operation corresponding to four colors, the exposure units may be combined as one body. Such a combined one-body structure is not particularly restricted in shape and arrangement.

Each of the developing units 5Y, 5M, 5C and 5BK includes developing rollers 51Y, 51M, 51C and 51 BK, respectively. These rollers oppose the outer circumferential surface of the photosensitive body 1, with a gap in the range of 50 to 200 $\mu$m maintained, e.g., with a gap of 150 $\mu$m maintained (the gap may vary, depending upon the characteristics of each toner). The developing units 5Y, 5M, 5C and 5BK also includes squeeze rollers 53Y, 53M, 53C and 53BK, and toner liquid-supplying mechanisms 54Y, 54M, 54C and 54BK, each of which has the same structure as the liquid supplying mechanism 54 of the developing units disclosed in FIGS. 2A, 2B. These rollers are positioned close to the respective developing rollers and downstream of them with respect to the rotating direction of the photosensitive body 1.

The squeeze rollers 53Y, 53M, 53C and 53BK of each of the developing units are provided with blades (not shown) which scrape developing liquids off the rollers 53Y, 53M, 53C and 53BK and permit the developing liquids to fall into housings 52Y, 52M, 52C and 52BK.

Each of the developing units 5Y, 5M, 5C and 5BK contain developing liquids corresponding to four colors Y, M, C and BK. Developing liquids include a solvent, resin and pigments. The solvent is added in such a manner that the nonvolatile component of the liquid developing agent accounts for one part by weight of the liquid developer. The resin and pigments are immersed in the solvent at a weight ratio of 4:1. The pigments are: a yellow pigment (KET Yellow 402; made by DAINIPPON INK AND CHEMICALS, INCORPORATED), a magenta pigment (KET Red 301; made by DAINIPPON INK AND CHEMICALS, INCORPORATED), a cyan pigment (Cyanin blue KRO made by Sanyo Color works, LTD) and a black pigment (#750B; made by MITSUBISHI CHEMICAL CORPORATION).

Predetermined developing bias voltages are applied to respective four developing regions, where the developing units 5Y, 5M, 5C and 5BK oppose the photosensitive body 1. The developing bias voltages enable efficient electrophoresis of the toners of the developing liquids and urge the toners toward the photosensitive body 1. The developing bias voltages are substantially equal or predetermined in accordance with the characteristics of the toners of the respective colors.

The toner (the developing liquid) is supplied to latent images formed on the photosensitive body 1 by the developing units 5Y, 5M, 5C and 5BK and corresponding to the respective colors. The supplied toner attached on the photosensitive body 1 by the electrostatic force acting between it and the photosensitive body 1, and is conveyed in accordance with the rotation of the photosensitive body 1. When the toner has come to the drying region where the toner opposes the blower 6 located near the black developing unit 5BK (the last developing unit) and downstream of it with respect to the rotating direction of the photosensitive body 1, most of the solvent is removed from the surface of the photosensitive body 1 and from between the toner particles.

After the removal of the solvent, the toner is conveyed toward a pressure roller 13 adapted for output transfer, which is located upstream of the first charging unit 3Y with respect to the rotating direction of the photosensitive body 1.

The color image forming apparatus shown in FIG. 6 is a transfer type apparatus, which does not employ an intermediate transfer member between the pressure roller 13 and the photosensitive body 1. As described above with reference to FIG. 1, however, the intermediate transfer member may be employed, if so desired.

A description will be given of an example of a process in which the color image forming apparatus shown in FIG. 6 outputs a color image.

A number of methods are known in the art as methods for producing color images by superposing four toner images. One of the methods is to superpose four-color toner images on the photosensitive body 1 and then transfer them onto a sheet P at a time. Another method is to superpose four-color toner images (each of which is a single-color image) on a sheet P by repeatedly bringing the sheet P into contact with the photosensitive body 1 or by employing one photosensitive body 1 and four developing units. Still another method is to superpose four-color toner images (each of which is a single-color image) on an intermediate transfer medium, and transfer the resultant color image from the intermediate transfer medium to a sheet P. The description below will focus on the thickness of superposed toner layers.

Figure 7:
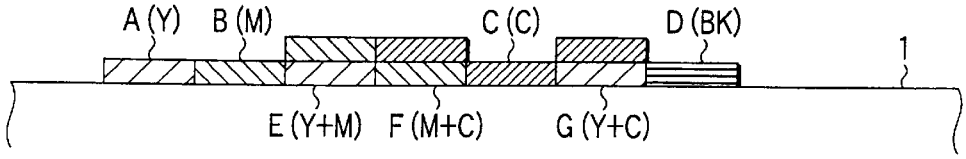
FIG. 7 is a schematic illustration showing how two or more toner layers superposed on each other are related in thickness in the color image forming apparatus depicted in FIG. 6.

Let us assume that four-color toners (images) are formed on the photosensitive body 1 in the order of Y (Yellow)→M (Magenta)→C (Cyan)→BK (Black) with referred in FIG. 7. In this case, a plurality of superposition patterns A to G are defined.

In general, the superposition patterns include:

patterns A to D wherein Y toner, M toner, C toner and BK toner form layers individually;

pattern E wherein the M toner layer is superposed on the Y toner layer;

pattern F wherein the C toner layer is superposed on the M toner layer; and pattern G wherein the C toner layer is superposed on the Y toner layer.

Since an actual pattern is dependent on the concentration of an image, there may be patterns other than patterns A–G shown in FIG. 7. In many cases (i.e., cases other than an irregular case), a BK toner layer (pattern D) is not overlaid with a superposition layer made up of the Y toner, M toner and C toner layers or with a layer of another color.

In the process of subtractive primaries, Y toner, M toner and C toner, which provide colors complementary to the three primary colors, are used in combination with C toner (which is used for emphasizing black). By use of these, W (white light) and the three primary colors, namely, B (Blue), G (Green) and R (Red), are reproduced. (The complementary-color toners are used in combination in such a manner that an image looks like an image of particular colors to a viewer.)

In order for the viewer to recognize B, an output image is a superposition of both M toner and C toner. Likewise, both Y toner and M toner are superposed for the viewer's recognition of R, and both Y toner and C toner are superposed for the viewer's recognition of G.

Where Y, M and C toner layers are to be superposed, they are replaced with a BK toner layer beforehand. Therefore, the three-color toners are not superposed, nor is a BK toner layer superposed on a layer of another color.

As can be seen from the foregoing, in the process of superposing four color toner images on the photosensitive body 1 and transferring them onto a sheet P at a time, the toner layer is defined as two-layered structure, except for the toner layer portion of an irregular case, i.e., the toner layer portion formed at a particular position. (In other words, no consideration is required with respect to the case where three or more toner layers are superposed).

It is thought, however, that the amount of toner used for forming single-color patterns A to D is not necessarily equal to the amount of toner used for forming the second-color toner patterns E to G (i.e., the patterns for forming toner layers of two colors).

For example, the first toner layer which is in direct contact with the photosensitive body 1 and the second toner layer which is formed on a toner layer already formed on the photosensitive body 1, differ from each other in light of their charging densities (with which the respective toner layers are attracted toward the photosensitive body 1). It can be readily understood that the thickness of the second toner layer may not be equal to the first toner layer of the same color.

At the time of squeeze, toner may separate from the photosensitive body 1 together with the solvent.

In the region where two toner layers are superposed-, the amount of toner which is part of the second layer and separates from the first layer is not necessarily equal to the amount of toner which is part of the first layer and separates from the photosensitive body 1 at the time of squeeze.

In the image region where two toner layers are superposed, therefore, the toner layer thickness measured by the ellipsometer 8 has to be corrected in accordance with the number of toner layers formed and the superposition order.

In the case of single-color patterns A to D, the thickness of a toner layer formed on the photosensitive body 1 can be considered to be the same as the measurement obtained by the ellipsometer 8, and no inconvenience is caused.

In the case of pattern E wherein the Y toner layer is overlaid with the M toner layer, however, the thickness of the pattern A (Y) is subtracted from the measurement of the thickness of pattern E (Y+M), thereby obtaining the thickness of only the M toner layer of pattern E. Likewise, in the case of pattern F wherein an M toner layer is overlaid with a C toner layer (M+C), the thickness of pattern B (M) is subtracted from the measurement of the thickness of pattern F (M+C), thereby obtaining the thickness of only the C toner layer of pattern F. Needless to say, this applies to pattern G (Y+C) as well. That is, the thickness of pattern C (Y) is subtracted from the measurement of the thickness of pattern G (Y+C), thereby obtaining the thickness of only the C toner layer of pattern G.

For the reasons described above, in the region where two-color toner layers are stacked one upon the other, the thickness of the second toner layer (namely the toner layer attached to the first toner layer, not to the photosensitive body 1) must be properly determined.

For example, in the case where a Y toner layer is overlaid with an M toner image (E pattern), the thickness of the E pattern must be measured first, and then the thickness of the Y-toner layer formed individually (A pattern), which is known beforehand, must be subtracted from the thickness of the E pattern.

As can be seen from the above, the thickness of the M-toner layer of E pattern and the thickness of the M-toner layer of B pattern must be compared with each other, and the amount of exposure light must be determined in such a manner as to attain an optimal thickness for the second M toner layer.

By way of example, let us consider the case where the M toner layer of pattern E is thinner (less) than the M toner layer of pattern B. In this case, when the M image that is the second layer of pattern E is exposed to light, the amount of exposure light is increased by lengthening the emission time of the laser used for forming the M image and increasing the duty ratio of driving pulses.

In the case where the M toner layer of pattern E is thicker (more) than the M toner layer of pattern B, the amount of exposure light is decreased by shortening the emission time of the laser used for forming the M image and decreasing the duty ratio of driving pulses. This control is executed only when the M image that is the second layer of pattern E is being exposed to light.

Instead of increasing or decreasing the amount of light, the number of dots constituting the second-layer M image may be changed. (The alternative method does not require a mechanism for changing the spot size or optical intensity of exposure light emitted from exposure unit. The method, which is generally utilized in printing, changes the image density by controlling the number of spots which exposure light of a single light intensity forms within a predetermined area.)

Likewise, in the case where the C toner layer (pattern F) is thinner (less) than the single C toner layer of pattern C, the amount of exposure light corresponding to the C image light must be increased by properly determining the emission time of the laser and the duty ratio of driving pulses. This control is executed when the image exposure corresponding to pattern F is being executed. In the case where the C toner layer (pattern G) is thinner (less) than the single Y toner layer of pattern A, the amount of exposure light corresponding to the C image light must be increased by properly determining the emission time of the laser and the duty ratio of driving pulses. This control is executed when the image exposure corresponding to pattern G is being executed.

The amount of exposure light required for forming a second layer in patterns E to G (wherein the second toner layer is superposed on the first toner layer) is predetermined at the time of shipping, and data on the amount of exposure light is stored in a memory 125, for example. Thereafter, the toner layer thickness measurement is executed at the timings determined on the basis of various developing conditions, including the total number of times image formation is executed after the apparatus is first used, the number of times image formation is executed in succession, the temperature and/or moisture of the place where the apparatus is installed, the elapse of time measured from the time when the apparatus in the OFF state is turned on, and the execution or non-execution of toner replenishment. In accordance with the toner layer thickness measurement, the data in the memory is rewritten.

A description will now be given with reference to FIGS. 8A and 8B as to how the thickness of each color toner layer is determined optimally. In the description below, reference will be made to the case where the measurement routine for measuring the toner layer thickness is executed independently of an ordinary image formation process. As described above, however, the toner layer thickness may be measured in parallel to the routine for the ordinary image formation process, using an area that is outside the image region corresponding to a maximal-size image (latent image) formed on the photosensitive body 1.

First of all, reflected light (polarized light) from a non-image portion is detected at an arbitrary position on the photosensitive body 1. Based on this detection, the toner layer thickness measuring device 8 is set at a level corresponding to the case where no toner layer exists on the photosensitive body 1 (S1).

Subsequently, the charging unit 3Y charges the photosensitive body 1 to a predetermined potential, using the initial value stored in the memory 125 (S10). Then, the exposure unit 4Y forms latent images in accordance with the initial amount of exposure light stored in the memory 125. The latent images correspond to a Y image (pattern A), the first layer of a (Y+M) image (pattern E), and the first layer of a (Y+C) image (pattern G) (S11).

The Y latent image (pattern A), the latent image corresponding to the first layer of the (Y+M) image (pattern E), and the latent image corresponding to the first layer of the (Y+C) image (pattern G), are developed by use of the Y developing liquid contained in the developing unit 5Y, thereby obtaining Y toner images. The developing bias voltage applied to the developing roller 51Y at the time is determined on the basis of the initial value stored in the memory 125 (S12).

Next, the charging unit 3M charges the photosensitive body 1 to a predetermined potential, using the initial value stored in the memory 125 (S20). The exposure unit 4M forms latent images in accordance with the initial amount of exposure light stored in the memory 125 (S21). The latent images correspond to an M image (pattern B), the second layer of the (Y+M) image (pattern E) and the first layer of an (M+C) image (pattern F).

The M latent image (pattern B), the latent image corresponding to the second layer of the (Y+M) image (pattern E), and the latent image corresponding to the first layer of the (M+C) image (pattern F), are developed by use of the M developing liquid contained in the developing unit 5M, thereby obtaining M toner images. Needless to say, a color exhibits the pattern E is an intermediate color (a fifth color) not same any one of the colors of the first to fourth colors of each of the toners. The developing bias voltage applied to the developing roller 51M at the time is determined on the basis of the initial value stored in the memory 125 (S22).

Thereafter, the charging unit 3C charges the photosensitive body 1 to a predetermined potential, using the initial value stored in the memory 125 (S30). The exposure unit 4C forms latent images in accordance with the initial amount of exposure light stored in the memory 125 (S31). The latent images correspond to a C image (pattern C), the second layer of the (M+C) image (pattern F) and the second layer of a (Y+C) image (pattern G).

The C latent image (pattern C), the latent image corresponding to the second layer of the (M+C) image (pattern F), and the latent image corresponding to the second layer of the (Y+C) image (pattern G), are developed by use of the C developing liquid contained in the developing unit 5C, thereby obtaining C toner images. Each of colors presences the patterns found G are intermediate colors (a fifth color and a sixth color), each not same any one of the colors of each of Y, M, C and BK toners. The developing bias voltage applied to the developing roller 51C at the time is determined on the basis of the initial value stored in the memory 125 (S32).

Subsequently, the charging unit 3BK charges the photosensitive body 1 to a predetermined potential, using the initial value stored in the memory 125 (S40). The exposure unit 4BK forms a latent image in accordance with the initial amount of exposure light stored in the memory 125 (S41). The latent image corresponds to a BK image (pattern D).

The BK latent image (pattern D) is developed by use of the BK developing liquid contained in the developing unit 5BK, thereby obtaining a BK toner image. The developing bias voltage applied to the developing roller 51BK at the time is determined on the basis of the initial value stored in the memory 125 (S42).

The seven toner layers formed on the photosensitive body 1 and including superposition patterns made of four color toners are carried to the drying region in accordance with the rotation of the photosensitive body 1. In the drying region, most of the solvent is removed from the toner layers. The toner layers are then carried to the toner layer thickness measurement position, where the ellipsometer 8 measures the thickness of the seven toner layer patterns A to G including the superposition patterns formed on the photosensitive body 1 (S13, S23, S33, S43).

Subsequently, the overall thicknesses of the toner layers of patterns E, F and G are measured, and the thicknesses of the Y toner layer (pattern A), M toner layer (pattern. B) and Y toner layer (pattern A), which are the first layers of the patterns, are subtracted from the overall thicknesses (S24, S34).

The thickness of each toner layer, thus measured, is compared with a reference value stored in the memory 125 (S14, S25, S35, S44). Based on this measurement, a check is made to see whether there is a toner layer whose thickness should be changed (S15, S26, S36, S45).

Next, the main control device 111 determines control amounts (S16, S27, S37, S46), which are applied to the toner layer whose thickness must be changed. The control amounts are amounts in which to vary the charging voltage to be applied to the charging units 3Y, 3M, 3C and 3BK, the developing bias voltage applied to the developing rollers 51Y, 51M, 51C and 51BK, or the optical intensities of the exposure light emitted from the exposure units 4Y, 4M, 4C and 4BK.

Next, steps S16, S27, S37 and S46 are executed, in which the control amounts obtained by the main control device 111 are changed. For example, the outputs of the power supply device 2 (based on which outputs from the charging units Y, M, C and BK are controlled) and/or the developing bias voltages which the developing bias power supply devices (not shown) apply to the developing rollers 51, i.e., the developing contrast potential, are changed.

In addition, the developing units SY, 5M, 5C and 5BK are checked to see if they require replenishment of an additional condensed toner liquid. The condensed toner liquid is supplied to the developing units SY, 5M, 5C and 5BK, is required (S17, S28, S38, S47).

Pattern E, pattern F and pattern G, which are superposition patterns of two toner layers, are checked to see if the thicknesses of their second layers are different from the reference values. Upon detection of a difference, either the optical intensity or the light amount of exposure light emitted from the exposure units 4M and 4C is varied (S29, S39).

The cleaner 10 removes the toner from the photosensitive body 1, and the mode is then switched back to the ordinary image formation mode (S2).

If the ordinary image formation is designated, the exposure units 4Y, 4M, 4C and 4BK charge the photosensitive body 1 to predetermined potentials, and images of corresponding color components are formed by light exposure. That is, the exposure units 4Y, 4M, 4C and 4BK from latent images on the photosensitive body 1, and the latent images, thus formed, are developed by the developing units 5Y, 5M, 5C and 5BK, which contain the toner liquids of respective colors. By means of the blower 6, the solvent is removed from the developed images, thereby forming toner images (color images) (S3).

The toner images are transferred onto the intermediate transfer member 7. In accordance with the rotation of the intermediate transfer member 7, the toner images are carried toward the transfer position, where the backup roller and the intermediate transfer member 7 are in contact with each other (S4). The toner images that have been carried to the transfer position are transferred onto (by the pressure exerted between the intermediate transfer member 7 and the backup roller 11) a sheet (S5). The residual toner, which remains on the photosensitive body 1 after transfer, is removed by the cleaner 10, thereby enabling the next-time image formation.

A description will be given as to how the condensed replenishment toner liquid-supplying mechanism 54 performs a replenishment operation to make up for the toner consumed by the development of latent images formed on the photosensitive body 1, in the developing apparatus described above with reference to FIGS. 2A and 2B. An example of a method for the toner replenishment will be described.

It should be noted that a toner liquid is not added in association with the thickness the ellipsometer 8 measures with respect to a toner layer formed on the photosensitive body 1.

During the image formation operation or in the toner layer thickness measurement mode, the concentration sensor 55 measures the toner density in the toner liquid contained in each developing unit 51 at predetermined timings (intervals) or continuously.

In the description below, it is assumed that the toner density in the toner liquid accounts for 0.7 to 1.3% by weight, and that the thickness of the first layer of the toner layer formed on the photosensitive body 1 is in the range of 0.9 to 1.1 $\mu$m when the image formation conditions are predetermined reference conditions.

Let us assume that the thickness of one of the toner layers of patterns A to G formed on the photosensitive body 1 is measured by the ellipsometer 8 as being smaller than the reference value, e.g., 1 $\mu$m, more than 20%, for example. In this case, the main control device 111 refers to the toner density sensed by the concentration sensor 55.

Even when the toner density of the toner liquid is higher than the reference value, this does not mean that the condensed toner liquid is supplied without delay. That is, the developing bias voltage applied to the developing roller 51 by the developing bias power supply device 151, i.e., developing contrast potential, is increased, first of all.

When the developing contrast potential is maximal in its variable range, the condensed replenishment toner liquid-supplying mechanism 54 is operated for a predetermined length of time under the control of the main control device 111. As a result, a predetermined amount of condensed toner liquid is additionally supplied into the housing 52 of the developing unit 51 that contains the toner liquid corresponding to a thin toner layer.

In the case where the thickness of one of the toner layers of patterns A to G formed on the photosensitive body 1 is measured by the ellipsometer 8 as being larger than the reference value (e.g., 1 $\mu$m) more than a predetermined rate (e.g., 20% in the present embodiment), the main control device 111 decreases the output of the developing bias power supply device so that the developing bias voltage applied to the developing roller 51, developing bias potential, may decrease.

Even when the toner layer thickness is sensed as being more than 20% larger than 1 μm, there may be a case where the toner density of the toner liquid sensed by the concentration sensor 55 is more than 40% lower than the reference value, namely, 1.0 (percent by weight). In this case, the condensed replenishment toner liquid-supplying mechanism 54 is operated for a predetermined length of time, and the main control device 111 decreases the output of the developing bias power supply device 151 (developing bias potential) in such a manner as to lower the developing bias voltage applied to the developing roller 51.

As described above, the image forming apparatus of the present invention, which employs wet-type developing units using a developing (toner) liquid, can accurately measure the thickness of a toner image (layer) obtained by use of toner whose particle diameter is approximately 1 μm, and the accurate measurement is attained by a measurement system using polarized light. With this structure, output images have a stable image density. Moreover, the adjustment of the developing contrast potential (the voltage difference between the surface potential of the photosensitive body and the developing bias voltage), the adjustment of the amount of exposure light, the control of toner replenishment timing, etc. can be executed on the basis of the measured toner thickness, independently of one another or in relation to one another. By virtue of this, images of high quality can be output without being affected by the environment of the apparatus, and this advantage is ensured for a long period of time.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electrophotographic developing apparatus which develops a latent image on a photosensitive body by use of a toner liquid in which toner is dispersed in a non-polarity solvent and which forms a toner image on the photosensitive body, said electrophotographic developing apparatus comprising:

a photosensitive body which holds an electrostatic image;

a charging unit which provides the photosensitive body with a predetermined potential;

an exposure unit which forms an electrostatic image on the photosensitive body;

a developing unit which includes a developing roller opposing the photosensitive body with a predetermined gap maintained, and which supplies a toner liquid to the electrostatic image formed on the photosensitive body such that toner is selectively attached to the electrostatic image, thereby forming a toner image;

a developing bias source which applies a predetermined bias voltage to the developing unit;

a toner layer thickness-detecting mechanism which detects the thickness of toner constituting the toner image, said toner layer thickness-detecting mechanism including an emission system which emits polarized light toward the toner image formed by the developing unit, and a reception system which receives the polarized light reflected by the toner image and produces an electric signal;

an image formation condition-controlling device which controls at least one of an output from the charging unit, an output from the exposure unit and the bias voltage applied by the developing bias source, on the basis of the thickness of the toner layer detected by the toner layer thickness-detecting mechanism; and a toner liquid replenishment mechanism which supplies the developing unit with a toner liquid whose toner density is a predetermined value, said toner density being a ratio representing how much the toner is dispersed in the non-polarity solvent.

2. The developing apparatus according to claim 1, wherein said toner layer thickness-detecting mechanism includes an ellipsometer.

3. The developing apparatus according to claim 1, wherein said image formation condition-controlling device selectively operates the toner liquid replenishment mechanism such that selective operation is associated with one or all of an output of the charging unit, an output of the exposure unit, and the bias voltage applied by the developing bias source.

4. An electrophotographic developing method which develops a latent image on a photosensitive body by use of a toner liquid in which toner is dispersed in a non-polarity solvent and which thereby forms a toner image on the photosensitive body, the electrophotographic developing method comprising:

providing the photosensitive body with a predetermined potential;

forming a test image by exposure by use of an exposure unit;

forming a toner layer on the photosensitive body by developing the test image;

irradiating the toner layer with polarized light and measuring the thickness of the toner layer on the basis of reflected light reflected by the toner layer by use of a layer thickness-detecting mechanism, said toner layer thickness-detecting mechanism including an emission system which emits polarized light and a reception system which receives the reflected light and produces an electric signal; and comparing the thickness of the toner layer with a reference value and varying at least one of the potential provided for the photosensitive body, an intensity of exposure light output from the exposure unit, a toner density of the toner liquid and a developing bias voltage applied to a developing unit, wherein toner liquid replenishment is executed when the thickness of the toner layer is less than a predetermined value and the toner density of the toner liquid is within an allowable range.

5. The developing method according to claim 4, wherein said toner layer thickness-detecting mechanism includes an ellipsometer.

6. The developing method according to claim 4, wherein said reference value is stored in a memory.

7. The developing method according to claim 4, wherein at least one of the potential provided for the photosensitive body, the intensity of exposure light output from the exposure unit, and the developing bias voltage applied to the developing unit is varied to control a developing contrast potential, when the thickness of the toner layer is greater or less than a predetermined value and when the toner density of the toner liquid is within an allowable range.

8. A method which is based on subtractive primaries and forms a color image by using first-color toner, second-color toner and third-color toner, which produce first to third complementary colors to three primary colors and by further using seventh-color toner which emphasizes black, the method comprising:

rotating a photosensitive body at a predetermined rate;

charging the photosensitive body, which is capable of holding an electrostatic image thereon, to a predetermined potential that enables formation of a first-color toner image;

irradiating the photosensitive body with light corresponding to image data used for forming the first-color toner image;

forming the first-color toner image by supplying the first-color toner to an electrostatic image corresponding to the first-color toner image;

charging the photosensitive body, which is capable of holding an electrostatic image thereon, to a predetermined potential that enables formation of both a second-color toner image and a fourth-color toner image, the fourth-color toner image being an image obtained by superposing the first-color toner and the second-color toner;

irradiating the photosensitive body with light corresponding to image data used for forming the second-color toner image and the fourth-color toner image;

forming the second-color toner image and the fourth-color toner image by supplying the second-color toner to electrostatic images corresponding to the second-color toner image and the fourth-color toner image;

charging the photosensitive body, which is capable of holding an electrostatic image thereon, to a predetermined potential that enables formation of a third-color toner image, a fifth-color toner image and a sixth-color toner image, the fifth toner image being an image obtained by superposing the second-color toner and the third-color toner, and the sixth-color toner image being an image obtained by superposing the first-color toner and the third-color toner;

irradiating the photosensitive body with light corresponding to image data used for forming the third-color toner image, the fifth-color toner image and the sixth-color toner image;

forming the second-color toner image, the fifth-color toner image and the sixth-color toner image by supplying the second-color toner to electrostatic images corresponding to the second-color toner image, the fifth-color toner image and the sixth-color toner image;

charging the photosensitive body, which is capable of holding an electrostatic image thereon, to a predetermined potential that enables formation of a seventh-color toner image, the seventh-color toner image being formed without reference to an order in which the first to the sixth-color toner images are formed;

irradiating the photosensitive body with light corresponding to image data used for forming the seventh-color toner image;

forming the seventh-color toner image by supplying the seventh-color toner to an electrostatic image corresponding to the seventh-color toner image;

detecting the thickness of each toner layer of each of the toner images by use of a toner layer thickness-detecting device in a state where the photosensitive body is rotating, said toner layer thickness-detecting device including an emission system which emits polarized light toward each of the toner images, and a reception system which receives the polarized light reflected by each toner image and produces an electric signal;

comparing the thickness of each of the toner layers of each of the toner images with a reference value; and varying at least one of a potential provided for the photosensitive body to obtain a desired image, the amount of light output from an exposure unit to obtain the desired toner image, a toner density of a given toner liquid and a developing bias voltage applied to a developing unit containing the given toner liquid, in accordance with a result of comparison.

9. The method according to claim 8, wherein said toner layer thickness-detecting device includes an ellipsometer.

10. The method according to claim 9, wherein thicknesses of a second-color toner layer of the fourth-color toner image, a third-color toner layer of the fifth-color toner image and a third-color toner layer of the sixth-color toner image, respectively, are calculated by subtracting thicknesses of a first toner layer, a second toner layer and the third toner layer, which are first layers of the fourth toner image, the fifth toner image and the sixth toner image, respectively, from total thicknesses each corresponding to two layers.

11. The method according to claim 10, wherein an amount of light output from the exposure unit is changed to control the thicknesses of the second-color toner layer of the fourth-color toner image, the third-color toner layer of the fifth-color toner image and the third-color toner layer of the sixth-color toner image, respectively.

12. The method according to claim 9, wherein at least one of the potential provided for the photosensitive body and the developing bias voltage applied to the developing unit that contains a corresponding toner liquid is varied to control a developing contrast potential, when the thickness of at least one of the toner layers is greater or less than a predetermined value and when the toner density of the toner liquid is within an allowable range.

13. The method according to claim 9, wherein toner liquid replenishment is executed when the thickness of at least one of the toner layers is more than a predetermined value and the toner density of the toner liquid is less than a predetermined level.

14. The method according to claim 9, wherein at least one of the potential provided for the photosensitive body and the developing bias voltage applied to the developing unit that contains a corresponding toner liquid is varied to control a developing contrast potential, when the thickness of at least one of the toner layers is greater than a predetermined value and the toner density of the toner liquid is within an allowable range.

15. The method according to claim 9, wherein toner liquid replenishment is executed and at least one of the potential provided for the photosensitive body and the developing bias voltage applied to the developing unit that contains a corresponding toner liquid is varied to control a developing contrast potential, when the thickness of at least one of the toner layers is more than a predetermined value and the toner density of the toner liquid is less than a predetermined level.

16. The method according to claim 9, wherein a color of the seventh-color toner image corresponds a black image and each of a color of the first-color toner image, a color of the second-color toner image and a color of the third-color toner image corresponds at least one of a yellow image, a magenta image and a cyan image.

* * * * *